US007098432B2

(12) United States Patent
Rew et al.

(10) Patent No.: US 7,098,432 B2
(45) Date of Patent: Aug. 29, 2006

(54) COMBINED MICROWAVE OVEN AND HOOD

(75) Inventors: Ho Seon Rew, Seoul (KR); Sung Bae Song, Anyang-si (KR); Jong Hoon Kim, Goonpo-si (KR); Sang Bum Sohn, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/915,649

(22) Filed: Aug. 9, 2004

(65) Prior Publication Data

US 2005/0189349 A1 Sep. 1, 2005

(30) Foreign Application Priority Data

Feb. 26, 2004 (KR) ..... 10-2004-0013178

(51) Int. Cl.
*H05B 6/80* (2006.01)

(52) U.S. Cl. ..... 219/757; 126/21 A

(58) Field of Classification Search ..... 219/757, 219/681, 756, 758, 391, 400, 702; 126/21 A, 126/21 R, 273 A, 299 D, 299 R
See application file for complete search history.

(56) References Cited

U.S. PATENT DOCUMENTS

| | | | | |
|---|---|---|---|---|
| 4,601,279 | A * | 7/1986 | Guerin | 126/21 A |
| 5,886,330 | A * | 3/1999 | Kang et al. | 219/757 |
| 6,621,057 | B1 * | 9/2003 | Kim | 219/757 |
| 6,621,058 | B1 * | 9/2003 | Kim | 219/757 |
| 6,797,930 | B1 * | 9/2004 | Kim | 219/757 |
| 2005/0092745 | A1 * | 5/2005 | Yim et al. | 219/757 |

FOREIGN PATENT DOCUMENTS

KR 2003-0090900 12/2003

* cited by examiner

*Primary Examiner*—Quang Van
(74) *Attorney, Agent, or Firm*—Lee, Hong, Degerman, Kang & Schmadeka

(57) ABSTRACT

A combined microwave oven and hood is provided. The combined microwave oven and hood includes a cavity assembly including a cavity and an electronic equipment room disposed at one side of the cavity, a blower for generating an absorptive power of contaminated air, a filter for filtering the contaminated air absorbed through the blower, and a drawer type air curtain module, which is transferred to a front side of the cavity assembly as operated.

19 Claims, 8 Drawing Sheets

COMBINED MICROWAVE OVEN AND HOOD

BACKGROUND OF THE INVENTION

1. Field of the Invention

The present invention relates to a combined microwave oven and hood, and more particularly, to a combined microwave oven and hood with an air curtain generating apparatus.

2. Description of the Related Art

In general, a combined microwave oven and hood is a product with an exhaust function capable of exhausting hot air, odious smell, vapor and the like as well as functions as a microwave oven. The combined microwave oven and hood is installed at an upper side of an oven range to improve spatial use of a kitchen.

The construction and operation of the combined microwave oven and hood are disclosed in the prior arts, for example, Korean Patent Application Nos. 10-2002-0042575, 10-2002-0000280, etc. Accordingly, their detailed description will be omitted.

In the aforementioned prior arts, since a suction area is designed smaller than an upper area of the oven range, hot air, odious smell, vapor and the like are completely not suctioned.

The hot air, odious smell, vapor and the like that are not suctioned are directly transferred to a user, for example, a housekeeper, thus causing unpleasantness. Also, the hot air, odious smell, vapor and the like are transferred even to the kitchen, rooms, etc., thereby contaminating interior air and soiling inner walls of the kitchen or rooms.

Also, the prior art combined microwave oven and hood has a drawback in that the filter can be exchanged after unscrewing bolts coupled to an upper plate, separating the combined microwave oven and hood bodily, and separating a grill.

SUMMARY OF THE INVENTION

Accordingly, the present invention is directed to a combined microwave oven and hood that substantially obviates one or more problems due to limitations and disadvantages of the related art.

An object of the present invention is to provide a combined microwave oven and hood including an air curtain generating apparatus.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a combined microwave oven and hood including a cavity assembly including a cavity and an electronic equipment room disposed at one side of the cavity, a blower for generating an absorptive power of contaminated air, a filter for filtering the contaminated air absorbed through the blower, and a drawer type air curtain module, which is transferred to a front side of the cavity assembly as operated.

According to the combined microwave oven and hood of the present invention, contaminated air generated from the oven range is prevented from being diffused into a user positioned in front of the oven range, thereby capable of keeping the kitchen clean while cooking is performed.

Also, since the air curtain module is slid and transferred, it is easy to exchange the filter.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
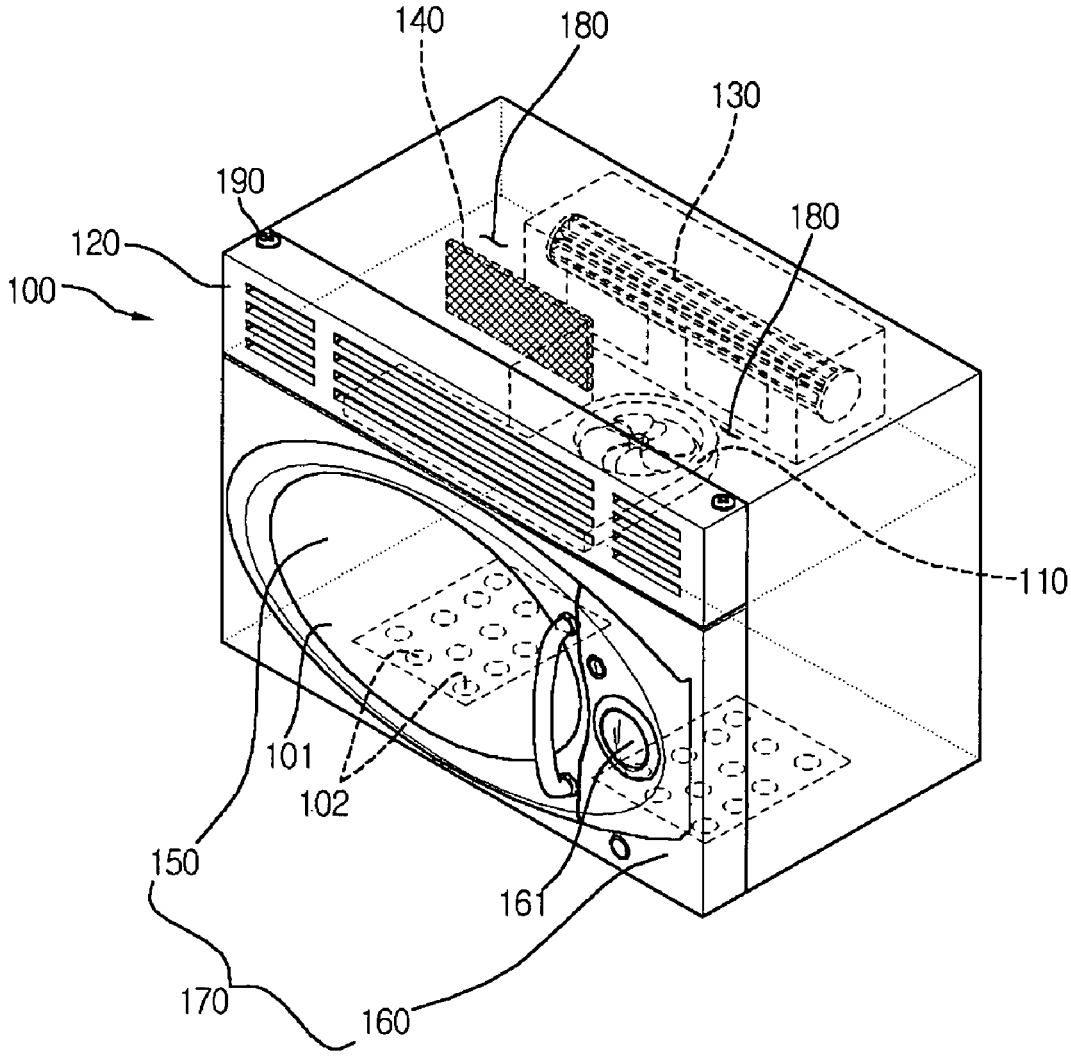
FIG. 1 is a perspective view of a microwave oven according to a spirit of the present invention.

FIG. 1 is a perspective view of a microwave oven according to a spirit of the present invention.

Referring to FIG. 1, the combined microwave oven and hood 100 includes a grill 120 installed at an upper side of a front side of the combined microwave oven and hood 100, and a centrifugal double suction blower 130 installed at an upper side of a rear side of the combined microwave oven and hood 100, for generating a suction power. The combined microwave oven and hood 100 further includes a filter 140 installed between the grill 120 and the centrifugal double suction blower 130, for filtering contaminated air, and an air passage 180.

The combined microwave oven and hood 100 further includes an air curtain module 110 for generating an air curtain.

The air curtain module 110 is preferably installed at an upper side of the combined microwave oven and hood 100 for spatial use and easy introduction of external air.

Also, the air curtain module 110 is designed in a drawer type.

In other words, the air curtain module 110 is in an insertion state into an inside of the combined microwave oven and hood 100 when the air curtain function is not required, whereas the air curtain module 110 is transferred to the front side of the combined microwave oven and hood 100 when the air curtain function is required.

Thus, since the air curtain module 110 is designed in the drawer type, the combined microwave oven and hood 100 can improve the spatial use of a kitchen.

Meanwhile, the combined microwave oven and hood 100 includes a cavity 150 that is a space used for cooking foods, and an electronic equipment room 160 where a variety of mechanical components and a controller are installed. The cavity 150 and the electronic equipment room 160 are called a cavity assembly 170.

Also, the combined microwave oven and hood 100 includes one or more fixed bolts 190 at an upper portion thereof. The combined microwave oven and hood 100 includes a base plate 101 and one or more suction inlets 102 formed on the base plate 101.

In detail, the electronic equipment room 160 includes a manipulation panel 161 having a variety of buttons for controlling operations of the combined microwave oven and hood 100.

Hereinafter, operations of the combined microwave oven and hood 100 constructed as above will now be described.

First, when a user performs a cooking operation at an oven range (not shown) disposed at a lower side of the combined microwave oven and hood 100, contaminated air such as hot air, odious smell and vapor is generated from the oven range.

To exhaust the contaminated air to an exterior, the user manipulates the manipulation panel 161, thereby turning on the exhaust function of the combined microwave oven and hood 100. Accordingly, a power is applied to the centrifugal double suction blower 130, so that the centrifugal double suction blower 130 starts to operate, thereby generating suction power.

The suction power causes the contaminated air generated in the over range to be suctioned into an interior of the combined microwave oven and hood 100 through the air inlets 102.

At this time, the air curtain module 110 should operate such that the contaminated air is transferred to the user who cooks foods in front of the oven range and is suctioned into the interior of the combined microwave oven and hood 100.

The operations of the air curtain module 110 will now be described with reference to FIG. 2.

Figure 2:
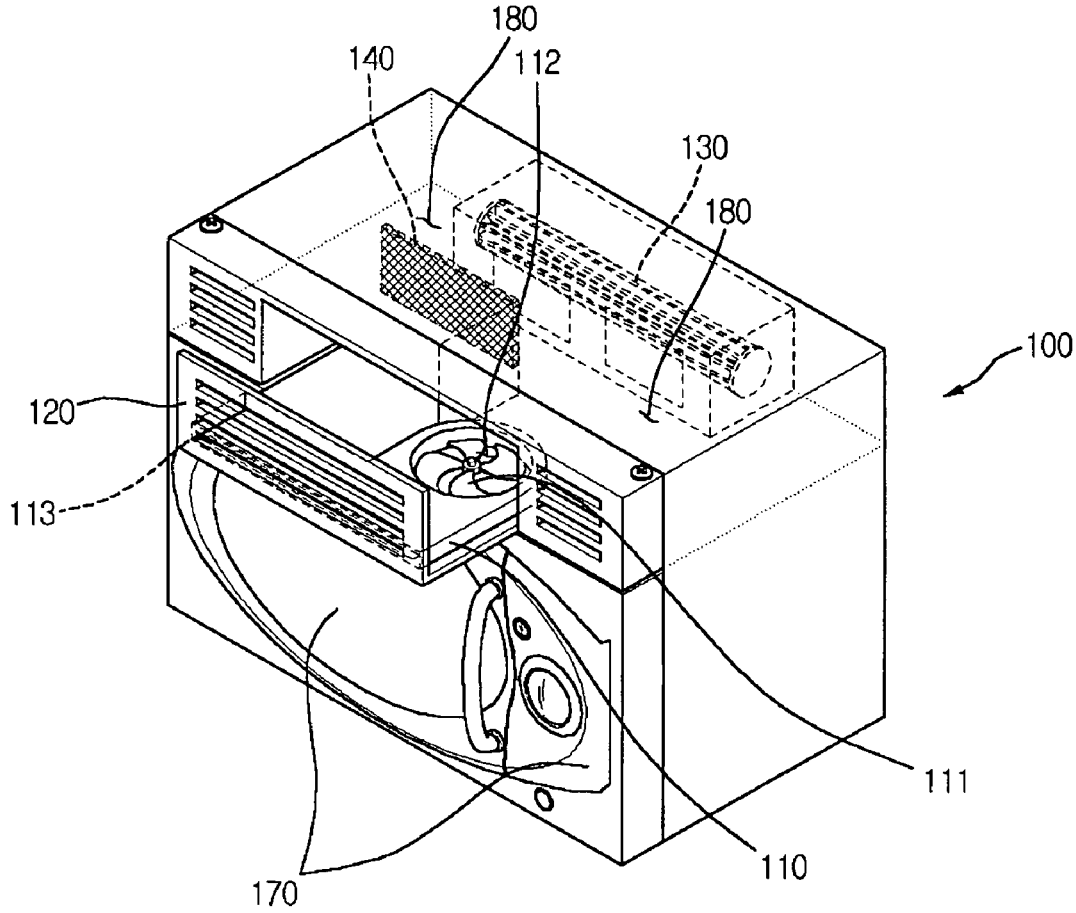
FIG. 2 is a perspective view illustrating an air curtain function of a combined microwave oven and hood according to the present invention.

FIG. 2 is a perspective view of the combined microwave oven and hood performing an air curtain function according to the present invention.

Referring to FIG. 2, the combined microwave oven and hood 100 includes the cavity assembly disposed at a lower side thereof, and the centrifugal double suction blower 130 for generating the suction power at an upper side thereof.

Also, the combined microwave oven and hood 100 further includes the air curtain module 110 for generating an air curtain flow, the filter 140 and the grill 120 for filtering contaminated air, and the air passage 180.

In detail, the air curtain module 110 includes a single suction centrifugal fan 111 installed at an inside thereof, for generating an air curtain.

Also, the air curtain module 110 includes an air passage 112 through which non-contaminated external air is introduced. The air curtain module 110 further includes one or more air outlets 113 formed at a lower side of the front side thereof, for exhausting air downward.

In the above, the shape, length and the like of the air curtain module 110 are not limited to those provided in the embodiments of the present invention, but various shapes, lengths and the like may be employed if it can generate such an air curtain.

Next, operation of the combined microwave oven and hood 100 when the air curtain module operates will now be described.

By a manual operation or automatic operation, the air curtain module 110 can be transferred to the front side of the combined microwave oven and hood 100.

When the user turns on an exhaust function of the combined microwave oven and hood 100, power is applied to the single centrifugal fan 111. As the single centrifugal fan 111 operates, a suction power is generated. Due to the suction power, non-contaminated external air is suctioned through the air inlet 112.

The suctioned air passes through the air passage formed in the air curtain module 110 and is then exhausted through the air outlet 113.

At this time, the air outlet 113 of the air curtain module 110 is directed toward a lower side of the combined microwave oven and hood 100 such that the exhausted air flows from the front side of the combined microwave oven and hood 100 to the lower side. Accordingly, by the downward flow of the exhausted air, an air curtain is formed.

The module portion disposed at the upper side of the air outlet 113 is preferably curved such that the air that has passed through the air passage can be effectively induced to the air outlet 113.

The contaminated air, which is generated from the combined microwave oven and hood 100 and directed toward the main portion of the combined microwave oven and hood 100, may be blocked by the air curtain. The blocked contaminated air is suctioned into the inside of the combined microwave oven and hood 100 through the air inlet 102 formed on the base plate 101.

Then, the suctioned contaminated air is suctioned into the centrifugal double suction blower 130 through the rear side of the electronic equipment room 160 and left and/or right passages of a side portion of the cavity 150. Thereafter, the contaminated air passes through the centrifugal double suction blower 130 and is then transferred to the front side of the centrifugal double suction blower 130.

After that, the contaminated air passes through the air passage 180 and is then filtered by the filter 140 installed on the passage 180. The filtered air is exhausted to the kitchen through the grill 120.

Meanwhile, the air curtain module 110 can be automatically transferred by a separate transfer unit, which is further provided for the convenience of the user.

Also, the air curtain module 110 may be further provided with a separate transfer rail for the convenience of the transfer.

Preferably, the air curtain module 110 may be depressed at one side thereof.

The depressed portion of the air curtain module-110 is used to exchange the filter 140 with ease after the transfer of the air curtain module 110 is completed.

In a modification, after the air curtain module 110 is transferred to the front side of the combined microwave oven and hood 100 and is completely separated from the combined microwave oven and hood 100, it is also possible to perform the exchange of the filter 140.

Figure 3:
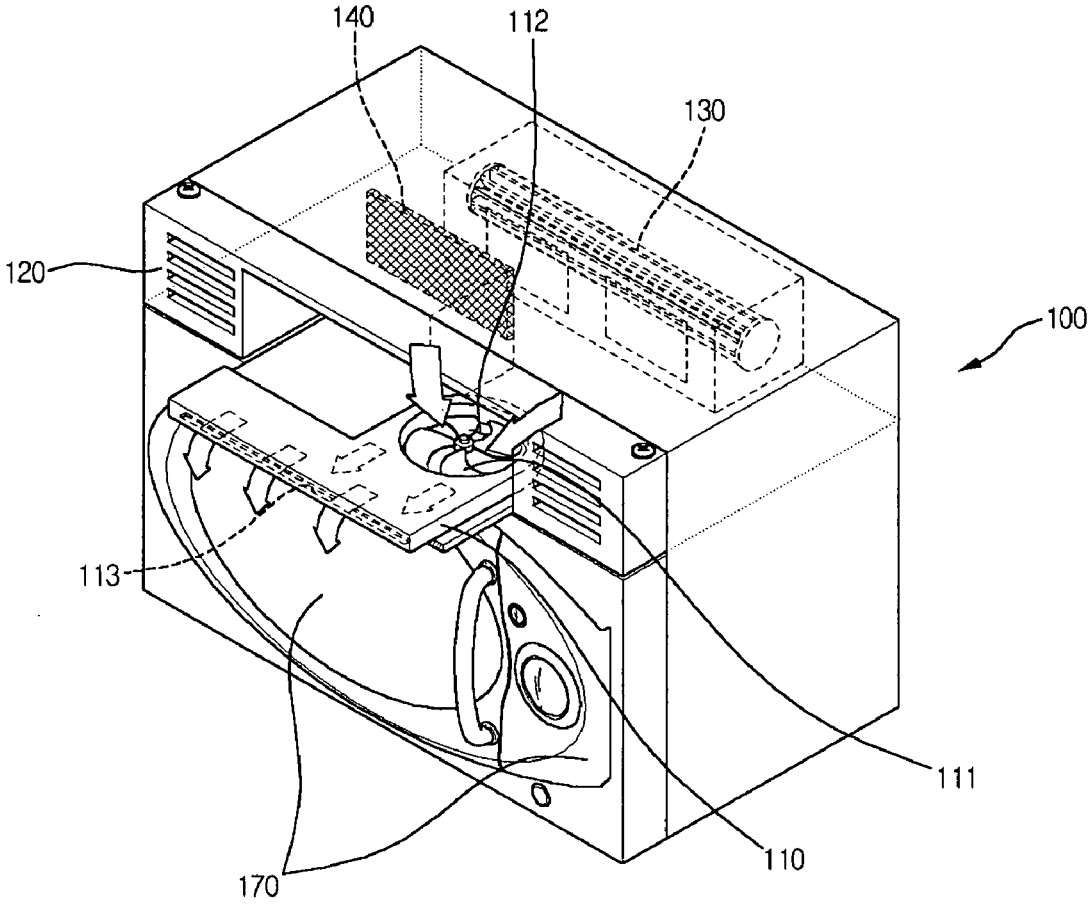
FIG. 3 is a perspective view illustrating operation of an air curtain module according to the present invention.
Figure 4:
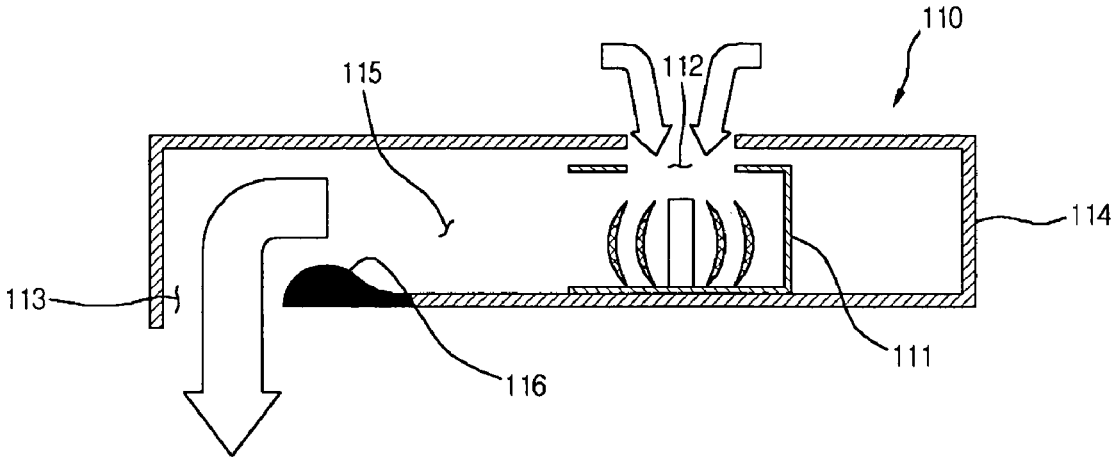
FIG. 4 is a vertical sectional view of an air curtain module.

FIG. 3 is a perspective view illustrating operation of an air curtain module according to the present invention, and FIG. 4 is a vertical sectional view of an air curtain module.

Referring to FIGS. 3 and 4, the combined microwave oven and hood 100 includes a cavity assembly 170 for cooking foods, and an air curtain module 110 for generating an air curtain.

In detail, the air curtain module 110 includes an air curtain module case 114 forming an appearance of the air curtain module 110, and an air inlet 112 formed at an upper portion of the air curtain module case 114, for suctioning non-contaminated air.

Also, the air curtain module 110 includes a single suction centrifugal fan 111 disposed at a lower side of the air inlet 112, for generating a suction power of an external air, and an air passage 115 through which suctioned external air flows.

The air curtain module 110 further includes an air outlet 113 formed at a front side of a lower side of the air curtain module case 114, for letting the air that has passed through the air passage 115 flow downward, and a nozzle 116 disposed at one side of the air outlet 113, for increasing flow rate of air.

Hereinafter, operations of the combined microwave oven and hood 100 constructed as above will be described.

First, as the exhaust function of the combined microwave oven and hood 100 is turned on, the single suction centrifugal fan 111 operates to generate a suction force. By the suction force generated, non-contaminated external air is suctioned into an interior of the air curtain module 110 through the air inlet 112.

The suctioned air passes through the air passage 115, and then flows downward through the air outlet 113, thereby forming an air curtain.

At this time, the flow rate of the air while the air passes through the nozzle 116 increases so that the air curtain is more effectively formed.

It will be apparent to those skilled in the art that the shape, length and the like of the nozzle 116 are not limited to those provided in the embodiments of the present invention but may be modified in various shapes and lengths if such modifications can increase the flow rate of the suctioned air.

Also, it will be apparent to those skilled in the art that the shape, length and the like of the air inlet 112 and the air outlet 113 are not limited to those provided in the embodiments of the present invention but may be modified in various shapes and lengths if such modifications can form the air curtain through smooth suction and exhaust of air.

When the single suction centrifugal fan 111 is used as the air curtain fan, production costs of the combined microwave oven and hood 100 can be saved.

Alternatively, a cross-flow fan may be used as the air curtain fan.

When the cross-flow fan is used as the air curtain fan, due to the characteristic of the cross-flow fan capable of changing flow direction, a design for changing the flow direction in the air curtain module 110 may not be required. To this end, the shape of the air curtain module 110 can be simplified.

FIGS. 5 through 8 are schematic views illustrating an upper air passage of the combined microwave oven and hood according to the present invention.

Since the combined microwave ovens and hoods proposed in FIGS. 5 through 8 is the same in the construction and shape as those proposed in FIGS. 1 through 4, their repeated description will be omitted.

Figure 5:
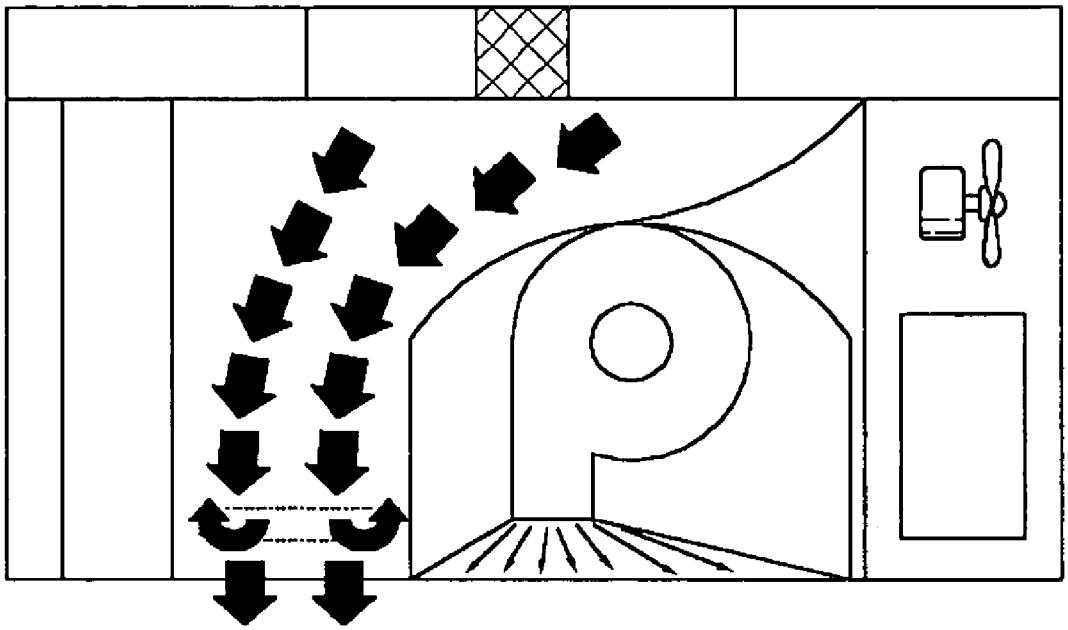
FIG. 5 is a schematic view illustrating installation of an air curtain module in a combined microwave oven and hood according to the present invention.
Figure 6:
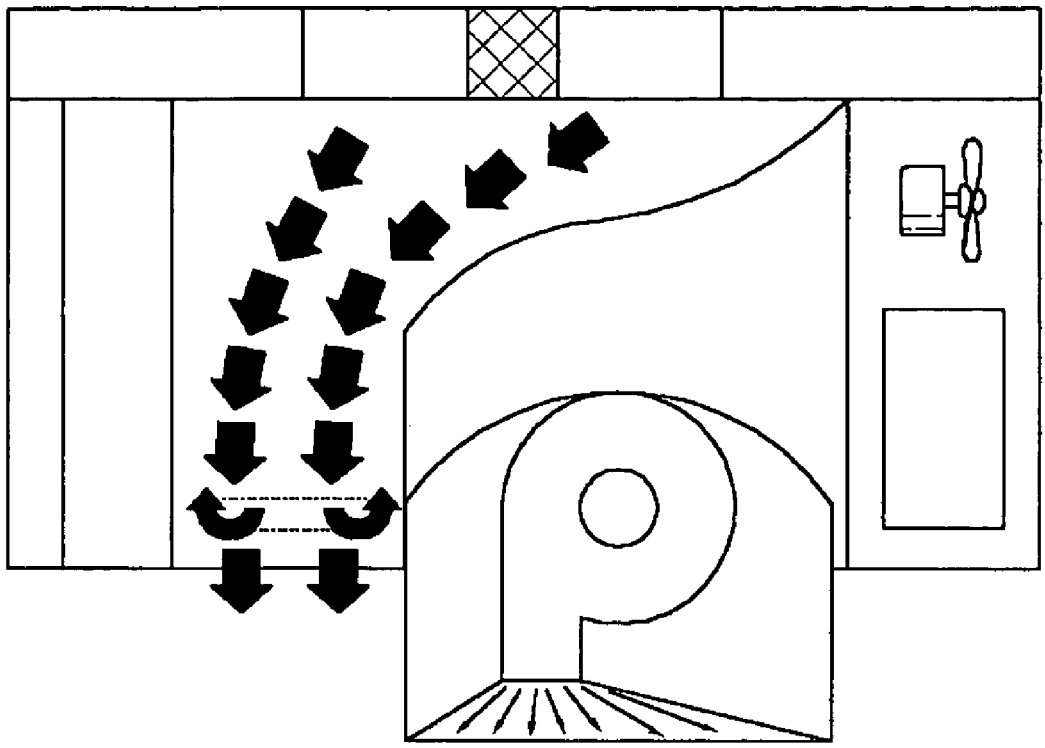
FIG. 6 is a schematic view illustrating an air curtain module as transferred such that the air curtain module operates.

Specifically, FIG. 5 is a schematic view illustrating installation of an air curtain module in a combined microwave oven and hood according to the present invention, and FIG. 6 is a schematic view illustrating an air curtain module as transferred such that the air curtain module operates.

Referring to FIGS. 5 and 6, a first air passage of a first flow of air discharged toward a front side of the combined microwave oven and hood and/or a second air passage formed by a second flow of air discharged upward auxiliary from the first flow are completely isolated from and are not mixed with a third air passage of the air curtain module.

Figure 7:
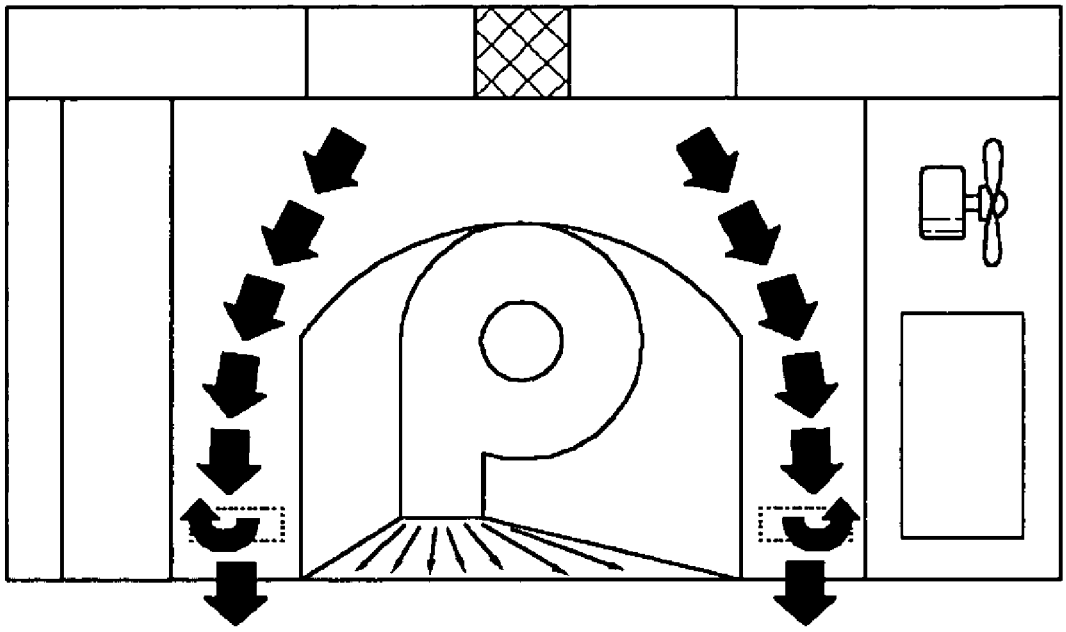
FIG. 7 is a schematic view illustrating an upper air passage of a combined microwave oven and hood according to another embodiment of the present invention.
Figure 8:
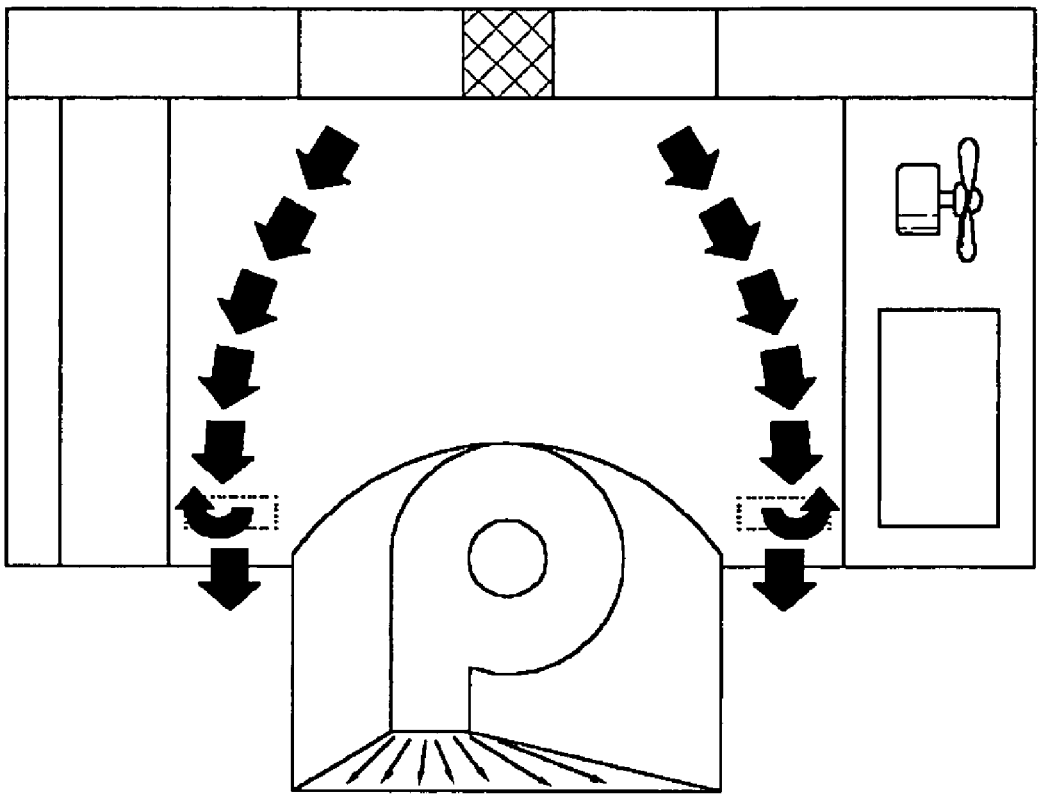
FIG. 8 a schematic view illustrating an air curtain module installed at the upper air passage of FIG. 7 as transferred such that the air curtain module operates.

FIG. 7 is a schematic view illustrating an upper air passage of a combined microwave oven and hood according to another embodiment of the present invention, and FIG. 8 a schematic view illustrating an air curtain module installed at the upper air passage of FIG. 7 as transferred such that the air curtain module operates.

Referring to FIGS. 7 and 8, air passages of front side discharge flow and auxiliary upward discharge flow are divided into both sides centering on the air curtain module. However, the air passages shown in FIGS. 7 and 8 are completely isolated from and are not mixed with the air passage of the air curtain flow, which is the same in effect as those shown in FIGS. 5 and 6.

Thus, by separating air passages of both flows from each other, contaminated air is prevented from being recirculated to the kitchen without being filtered through the air curtain flow.

In the above, it will be apparent that the air passage shapes of the front side discharge flow and the auxiliary upward discharge flow, and the air passage shape of the air curtain flow are not limited to those provided in the embodiments of the present invention but various modifications and changes may be proposed if such modifications and changes do not mix the respective flows and can generate the air curtain flow.

As described above, according to the combined microwave oven and hood of the present invention, contaminated air generated from the oven range is prevented from being diffused into a user positioned in front of the oven range, thereby keeping the kitchen clean.

Also, since the air curtain module is slid and transferred, it is easy to exchange the filter.

Further, since the air curtain module operates in a drawer type, spatial use of the kitchen when the air curtain module is not used, is improved.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A combined microwave oven and hood comprising:

a cavity assembly including a cavity and an electronic equipment room disposed at one side of the cavity;

a blower for generating an absorptive power of contaminated air;

a filter for filtering the contaminated air absorbed through the blower; and a drawer type air curtain module, which is transferred to a front side of the cavity assembly when operated and has a depressed portion at one side thereof for easing exchange of the filter.

2. The combined microwave oven and hood of claim 1, wherein the blower is a centrifugal double suction type blower.

3. The combined microwave oven and hood of claim 1, wherein the air curtain module comprises a single suction centrifugal fan for generating an air curtain.

4. The combined microwave oven and hood of claim 1, wherein the air curtain module comprises a cross-flow fan for generating an air curtain.

5. The combined microwave oven and hood of claim 1, wherein the air curtain module comprises an air inlet.

6. The combined microwave oven and hood of claim 1, wherein the air curtain module comprises an air outlet.

7. The combined microwave oven and hood of claim 1, wherein the air curtain module comprises an air outlet, and the air outlet is formed at a lower side of a front side of the air curtain module.

8. The combined microwave oven and hood of claim 1, wherein the air curtain module comprises a nozzle.

9. The combined microwave oven and hood of claim 1, wherein the air curtain module comprises an air outlet, and the air outlet has a curved portion at an upper side thereof.

10. The combined microwave oven and hood of claim 1, wherein the air curtain module comprises an air inlet and an air curtain fan disposed at a lower side of the air inlet.

11. The combined microwave oven and hood of claim 1, wherein the air curtain module is included in an upper portion of the cavity assembly.

12. The combined microwave oven and hood of claim 1, wherein the air curtain module comprises an external air passage through which external air is suctioned by the air curtain module, and a contaminated air passage through which the contaminated air is suctioned by the blower, and the external air passage and the contaminated air passage are separated from each other.

13. The combined microwave oven and hood of claim 12, wherein the contaminated air passage is divided into one or more branches at an upper portion of the cavity assembly.

14. The combined microwave oven and hood of claim 12, wherein the contaminated air passage is one formed at an upper portion of the cavity assembly.

15. A combined microwave oven and hood comprising:

a cavity assembly including a cavity and an electronic equipment room disposed at one side of the cavity;

a blower for generating a suction power of contaminated air;

a filter for filtering the contaminated air; and a drawer type air curtain module for generating an air curtain, which is transferred to a front side of the cavity assembly when operated.

16. A combined microwave oven and hood comprising:

a cavity assembly including a cavity and an electronic equipment room disposed at one side of the cavity;

a blower for generating an absorptive power of contaminated air;

a filter for filtering the contaminated air absorbed through the blower; and a drawer type air curtain module, which is transferred to a front side of the cavity assembly when operated;

wherein the air curtain module is transferred to and is completely separated.

17. A combined microwave oven and hood comprising:

a cavity assembly including a cavity and an electronic equipment room disposed at one side of the cavity;

a blower for generating an absorptive power of contaminated air;

a filter for filtering the contaminated air absorbed through the blower; and a drawer type air curtain module, which is transferred to a front side of the cavity assembly when operated;

wherein the air curtain module is transferred manually.

18. A combined microwave oven and hood comprising:

a cavity assembly including a cavity and an electronic equipment room disposed at one side of the cavity;

a blower for generating an absorptive power of contaminated air;

a filter for filtering the contaminated air absorbed through the blower;

a drawer type air curtain module, which is transferred to a front side of the cavity assembly when operated; and a transfer unit for automatically transferring the air curtain module.

19. A combined microwave oven and hood comprising:

a cavity assembly including a cavity and an electronic equipment room disposed at one side of the cavity;

a blower for generating an absorptive power of contaminated air;

a filter for filtering the contaminated air absorbed through the blower;

a drawer type air curtain module, which is transferred to a front side of the cavity assembly when operated; and a rail construction for transferring the air curtain module.

* * * * *